US007097165B1

(12) United States Patent
Braun

(10) Patent No.: US 7,097,165 B1
(45) Date of Patent: Aug. 29, 2006

(54) CARBURETOR FUEL ADJUSTMENT AND LIMITER ASSEMBLY

(75) Inventor: Matthew A. Braun, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/104,907

(22) Filed: Apr. 13, 2005

(51) Int. Cl.
*F02M 3/08* (2006.01)

(52) U.S. Cl. ..... 261/71; 137/382; 137/382.5; 261/DIG. 38; 261/DIG. 84

(58) Field of Classification Search ..... 261/71, 261/DIG. 38, DIG. 84; 137/382, 382.5; 411/301, 412, 542
See application file for complete search history.

(56) References Cited

U.S. PATENT DOCUMENTS

| | | | | | |
|---|---|---|---|---|---|
| 5,236,634 | A | | 8/1993 | Hammett et al. | 261/71 |
| 5,249,773 | A | * | 10/1993 | Feld | 251/129.11 |
| 5,252,261 | A | | 10/1993 | Gerhardy | 261/71 |
| 5,322,645 | A | | 6/1994 | Hammett et al. | 261/71 |
| 5,538,673 | A | * | 7/1996 | Edmonston | 261/44.3 |
| 5,603,869 | A | * | 2/1997 | McNew et al. | 261/71 |
| 5,635,113 | A | * | 6/1997 | Walsh et al. | 261/71 |
| 5,667,734 | A | | 9/1997 | Ohgane | 261/71 |
| 5,707,561 | A | | 1/1998 | Swanson | 261/71 |
| 5,753,148 | A | | 5/1998 | King et al. | 261/71 |
| 5,955,007 | A | * | 9/1999 | Koizumi et al. | 261/67 |
| 5,961,896 | A | | 10/1999 | Koizumi et al. | 261/67 |
| 5,984,281 | A | * | 11/1999 | Hacker et al. | 261/71 |
| 6,234,458 | B1 | * | 5/2001 | Gerhardy | 261/71 |
| 6,302,384 | B1 | * | 10/2001 | Douyama | 261/71 |
| 6,402,124 | B1 | * | 6/2002 | Pattullo et al. | 261/71 |
| 6,402,125 | B1 | | 6/2002 | Burns et al. | 261/71 |
| 6,467,757 | B1 | | 10/2002 | Douyama | 261/71 |
| 6,491,288 | B1 | | 12/2002 | Nagata et al. | 261/71 |
| 2001/0026025 | A1 | * | 10/2001 | Nagata et al. | 261/71 |

FOREIGN PATENT DOCUMENTS

| | | | | |
|---|---|---|---|---|
| JP | 53-14234 | * | 2/1978 | 137/382.5 |

* cited by examiner

*Primary Examiner*—Richard L. Chiesa
(74) *Attorney, Agent, or Firm*—Reising, Ethington, Barnes, Kisselle, P.C.

(57) ABSTRACT

A carburetor fuel valve adjustment and limiter assembly for a combustion engine limits the maximum and minimum fuel amounts delivered through the valve of the carburetor. A needle valve of the adjustment and limiter assembly cooperates with a collar and pin generally located axially inward of an enlarged valve head. The collar of the limiter assembly is arranged telescopically with a valve shaft and yieldably biased to lock to the head when moved in an axially outward direction. When locked, and upon rotation of the valve, first and second stops carried by the collar are arranged to bear on a stationary pin carried by a carburetor body. During manufacture, the collar can be pushed axially inward against the bias of a spring to disengage the collar from the head to permit rotation of the needle valve while the collar remains stationary for unlimited adjustment of the needle valve.

20 Claims, 6 Drawing Sheets

CARBURETOR FUEL ADJUSTMENT AND LIMITER ASSEMBLY

FIELD OF THE INVENTION

This invention relates to a carburetor fuel adjustment assembly, and more particularly to a fuel adjustment and limiter assembly of a fuel needle valve of a carburetor for an internal combustion engine.

BACKGROUND OF THE INVENTION

Government agencies of an increasing number of countries are applying exhaust emission control regulations to protect the environment. These regulations are being applied to all combustion engines including engines used in marine, lawn and garden equipment such as outboard motors, garden tractors, chain saws, lawn mowers and hedge trimmers. One means of limiting excessive exhaust emissions in a small engine is to restrict the maximum amount of fuel delivered to the combustion chamber. This maximum fuel amount is pre-set on each individual engine by the engine manufacturer with the understanding that the end user requires some adjustment capability to meet changing work conditions and environmental factors such as altitude and ambient temperature. The higher the altitude and temperature, the lower the air density, and thus the amount of fuel mixed with the air must be decreased to maintain the proper oxygen to fuel ratio necessary to efficiently operate the engine. The user of the engine must therefore be able to adjust the fuel to air mixture ratios and may do so via low and high speed needle valves protruding from the carburetor.

Not only is it desirable to limit the richness of the fuel-to-air mixture because of exhaust emission regulatory concerns, but the engine manufacturer of a two cycle engine product also wants to restrict minimum amounts of fuel, or the leanness of the fuel to air mixture. Often a user will desire more power from a two cycle engine and will attempt to operate the engine in an ultra-lean state. This will cause a two cycle engine to operate at a temperature higher than its design temperature and may decrease its useful life and lead to service and warranty concerns. Therefore, known limiter caps are designed not only to restrict the carburetor to a maximum amount of fuel, but also to restrict the carburetor to a minimum amount of fuel.

Limiter caps secured to the projecting ends of the low and high speed needle valves are commonly used to restrict the end user from demanding too much fuel from a carburetor which could exceed regulatory emission limits. The user purchases the engine already factory set to a desired fuel amount, adequate for efficient operation in low lying areas. Should the engine be utilized in a high altitude area, the user can still decrease the amount of fuel supplied to compensate for the low air density and/or ambient temperature.

In a conventional needle valve, the valve has an enlarged metallic head having an outward end face that defines a diametric recess or slot for receipt of a tool or blade of a screwdriver to rotate the valve to adjust fuel flow. The limiter cap has a similar diametric recess or hole in an end wall for access of the screwdriver, and a continuous inner surface defining a bore for receipt of the head. The inner surface may have serrations which axially mate with serrations on the head so the limiter cap when in a user assembled state rotates in unison with the head. Typically, a peripheral side or outer surface of the limiter cap has at least one radially projecting tab which engages at least one stop of the carburetor body in both the fuel rich and fuel lean directions and thereby limits fuel adjustment capability by the end user.

Due to carburetor and engine design and manufacturing tolerances, a manufacturer's setting of a specific carburetor to an optimum fuel amount prior to use on a specific engine, or within a specific environment such as altitude, is not practical. The limiter cap assembly is therefore supplied in a non-engaged mode in which the cap is not mated to the needle valve head and is often separate from the carburetor itself. Unfortunately, supplying a carburetor with un-assembled parts contributes to manufacturing or assembly inefficiencies and possible regulatory violations if the caps are never actually fully engaged to the valves.

Other needle valve assemblies, such as that disclosed in U.S. Pat. No. 6,467,757, to Douyama, and incorporated herein by reference, have a limiter cap which is pre-engaged to the carburetor body by the carburetor manufacturer for delivery to the engine manufacturer who then engages and locks the limiter cap to the valve head after final adjustments are made during operation on a specific engine. Three axially spaced projections disposed on the outer surface of the limiter cap are required to press-fit and hold the cap in the pre-engaged position and then to press-fit and lock the cap in the engaged position. When pre-engaged, the limiter cap projects outward from the carburetor body and the valve head, and the un-mated serrations of the valve head are spaced axially away from the serrations of the limiter cap. When the limiter cap is pre-engaged, a screwdriver blade is inserted through the cap hole for factory rotational adjustment of the needle valve while the limiter cap is un-mated from the needle valve. Upon adjustment completion, the caps are press fitted directly over the needle valve head, mating the serrations and received in the carburetor body. Once engaged to the valve head, the end user has restricted adjustment of the needle valve by rotating the limiter cap which, in-turn, rotates the needle valve.

Unfortunately, during factory adjustment, if a worker employee misses the elongated hole with the screwdriver, the limiter cap may inadvertently be pushed-in axially into engagement with the needle valve head and thereby prevent factory adjustment without destroying the cap by forcibly removing it. Furthermore, the press-fit between the cap projections and the carburetor body requires that the cap be made of a resilient synthetic resin material such as nylon or other resilient thermoplastic material.

Yet further, government agencies are beginning to disapprove limiter caps made of plastic material for fear they are not completely tamper proof and ultimately can be forcibly removed by the end user. Simply switching known plastic limiter caps to a metal material is not workable because they require a degree of resiliency and pliability to be press fitted over the needle head.

SUMMARY OF THE INVENTION

A fuel adjustment and limiter assembly for a carburetor of a combustion engine limits the maximum and minimum fuel amounts delivered adjustably through the carburetor, by preferably at least one fuel needle valve. A shaft of the needle valve engages threadably to the carburetor body in the cavity for axial movement of a needle or distal end of the shaft into the fuel passage for adjustably obstructing fuel flow through the passage. The limiter assembly has a collar arranged telescopically with the enlarged head and orientated circumferentially with a pin disposed in the bore and engaged generally to the body. The collar, shaft and enlarged head are preferably sheltered completely within the carburetor body for tamper-proof protection.

Normally, the collar is biased into a locked position with the head by a compression spring which generally pushes the collar axially outward against the enlarged head causing mating indices of the collar to mate with mating features of the enlarged head. When locked, rotation of the head by an end user causes the collar to rotate with the head. An axially inward projecting canopy of the collar carries circumferentially opposing first and second stops which when in contact with the pin limit the rotation in either direction and thus set an adjustment range. During manufacture, this adjustment range is set either in a fuel rich or opposite fuel lean direction by first rotating the needle valve and locked collar until the pin circumferentially align to an axially extending slot in the collar, then moving the collar axially inward against the bias of the spring placing the pin in the slot. With the pin in the slot, the collar is spaced axially inward from the enlarged head and the previously mated features and indices are un-mated designating an unlocked position of the collar. When the collar is in the unlocked position, the pin prevents rotation of the collar with respect to the enlarged head. The head can then be rotated and the mating indices and features repositioned. Once the range is adjusted, release of the collar causes the force of the spring to shift the collar axially outward, re-engaging the collar with the head and causing the pin to slip out of the slot and re-align axially with the first and second stops.

Objects, features and advantages of this invention include a tamper-proof fuel mixture adjustment assembly which is completely pre-assembled to the carburetor prior to delivery to an engine manufacture, has an adjustment range which can easily be reset during manufacture, and yet is tamper-proof by the end user. Further advantages include improved emissions, longer engine life, a simple, robust and inexpensive design, and has a long, useful and maintenance-free life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
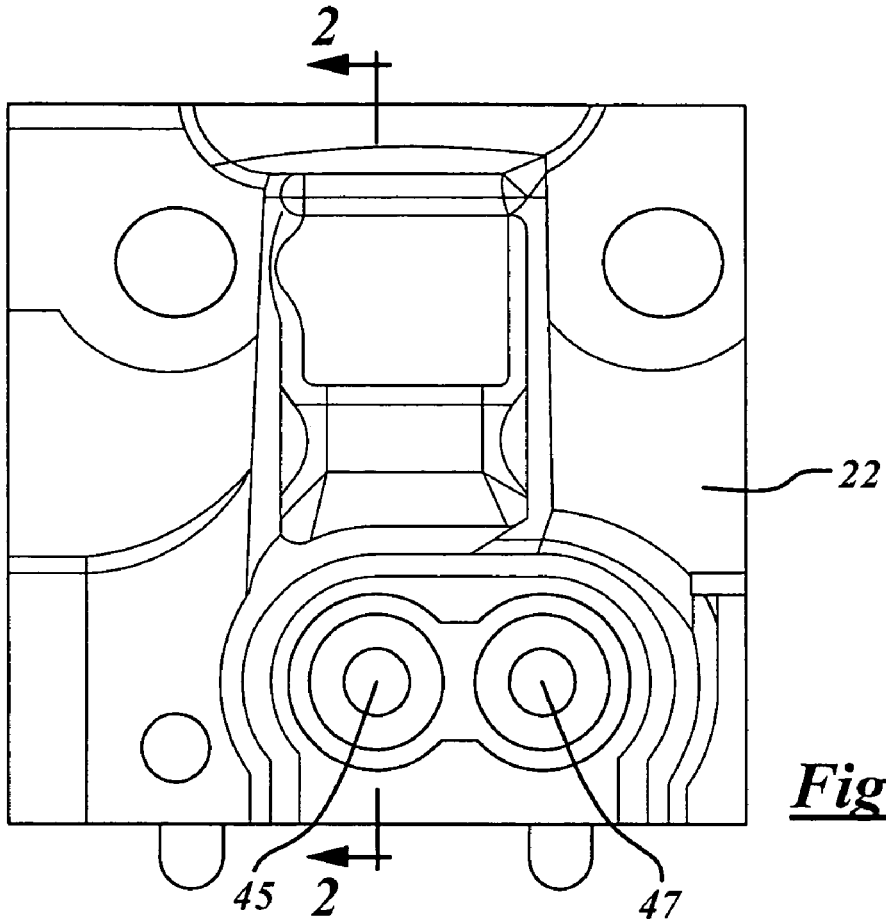
FIG. 1 is a side view of a carburetor body capable of utilizing a fuel adjustment and limiter assembly of the present invention.
Figure 2:
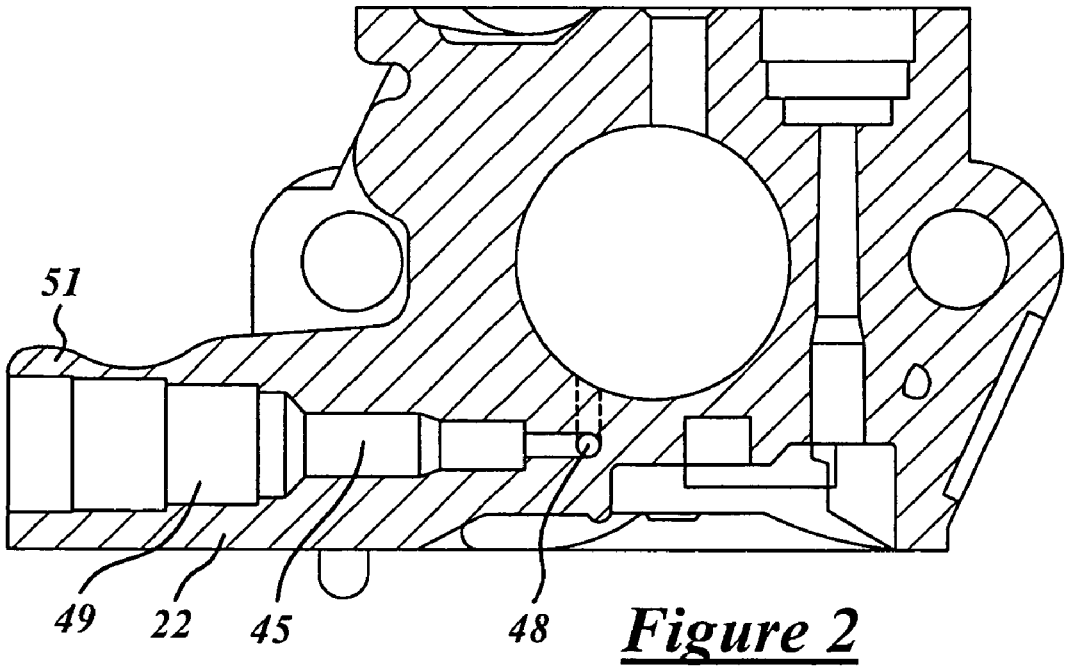
FIG. 2 is a cross section of the carburetor body taken along line 2—2 of FIG. 1.
Figure 3:
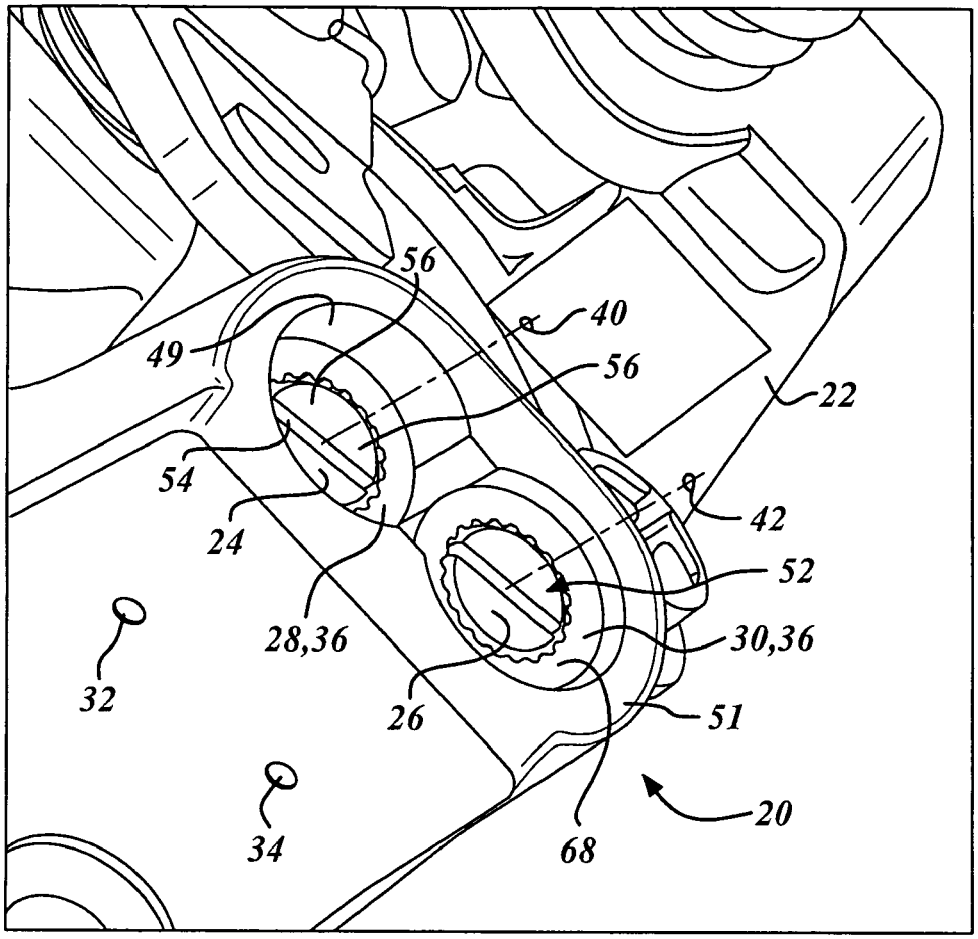
FIG. 3 is a perspective view of the fuel adjustment and limiter assembly in the carburetor body.
Figure 9:
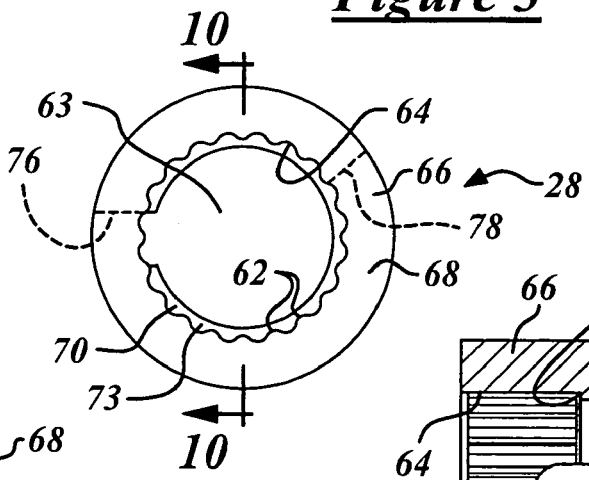
FIG. 9 is an end view of the collar.
Figure 8:
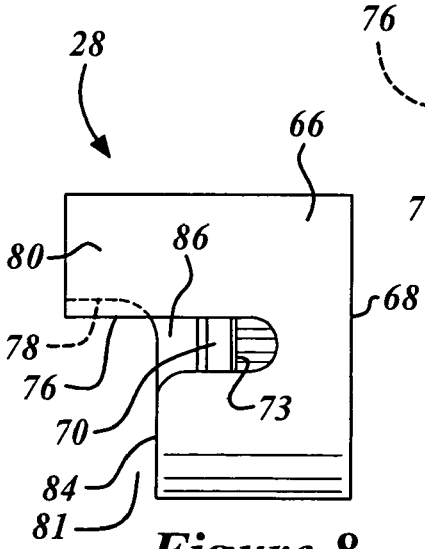
FIG. 8 is a side view of a collar of the fuel mixture adjustment assembly.
Figure 10:
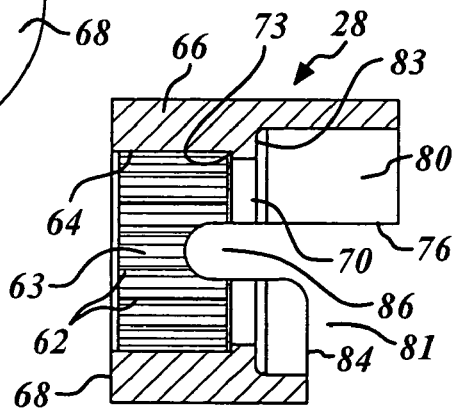
FIG. 10 is a cross section of the collar taken along line 10—10 of FIG. 9.
Figure 4:
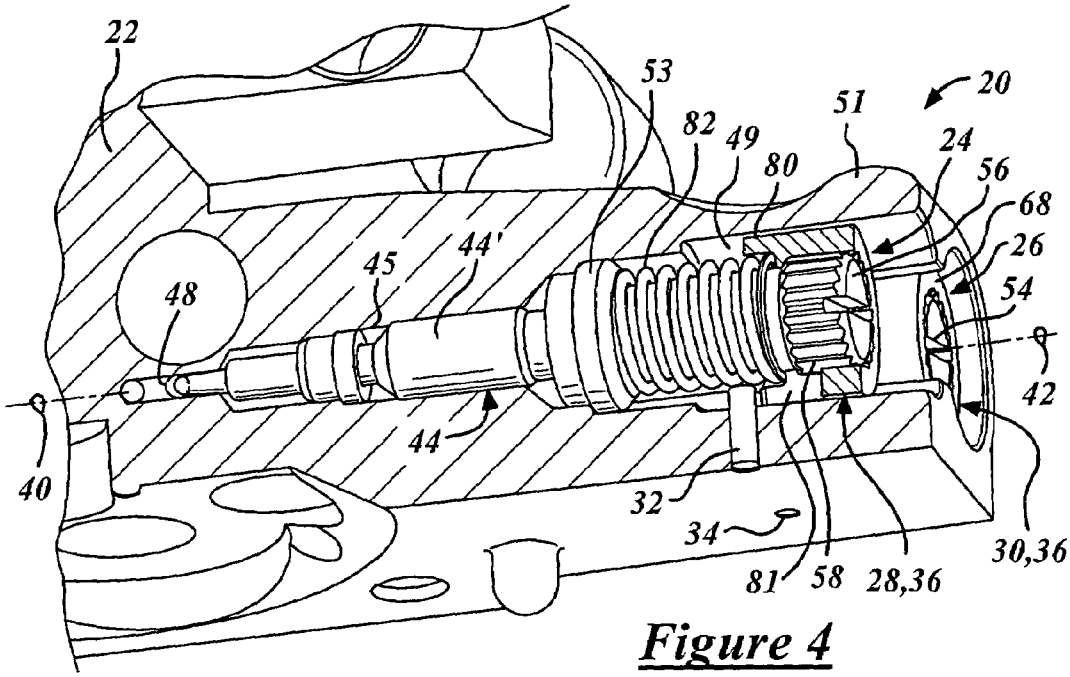
FIG. 4 is a perspective view of the fuel adjustment assembly in a locked position with portions of the carburetor body in section to show internal detail.
Figure 5:
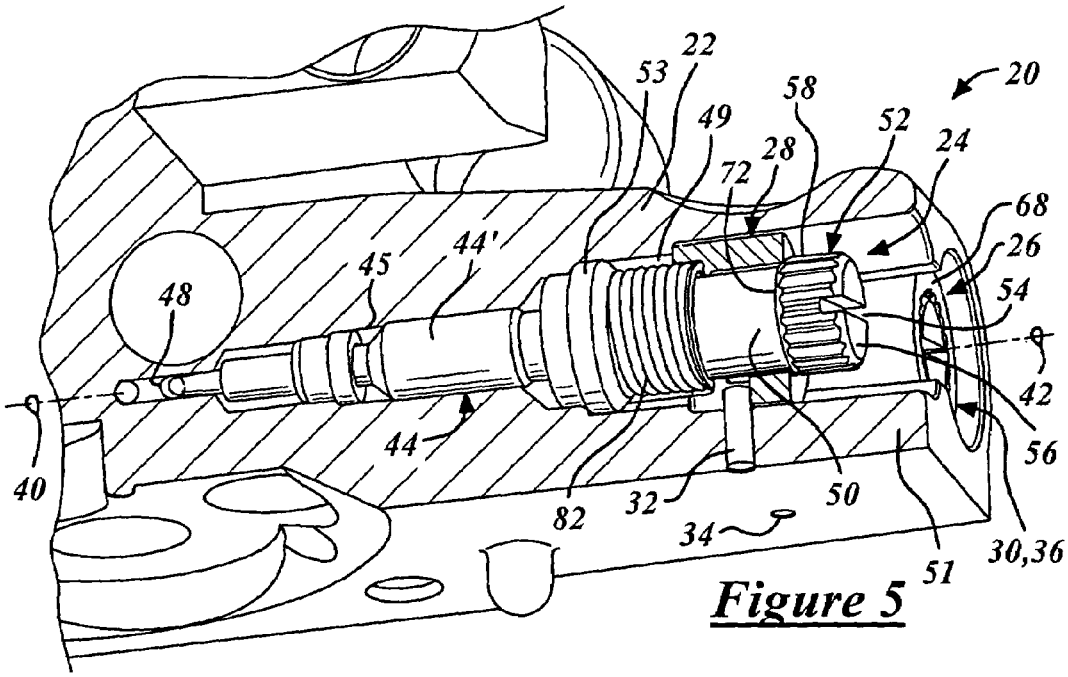
FIG. 5 is a perspective view of the fuel adjustment and limiter assembly similar to FIG. 4 except illustrating a low speed needle valve in an un-locked position.
Figure 6:
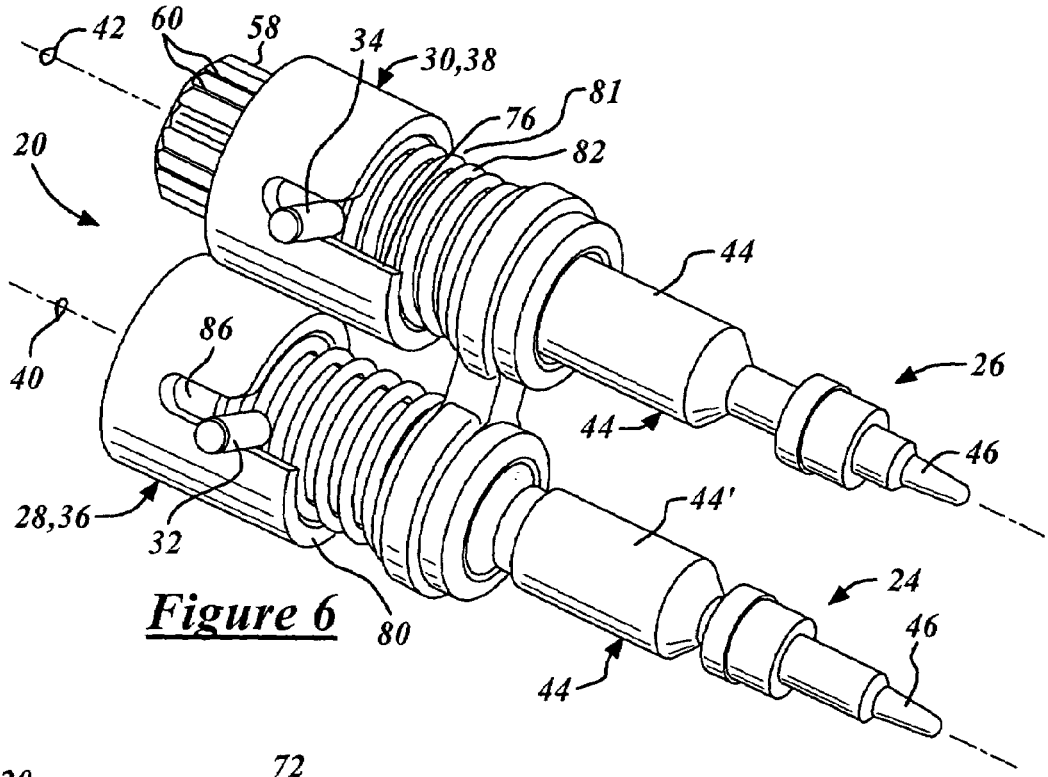
FIG. 6 is a perspective view of the fuel mixture adjustment valves illustrating the low speed needle valve in a locked position and a high speed needle valve in an unlocked position.
Figure 7:
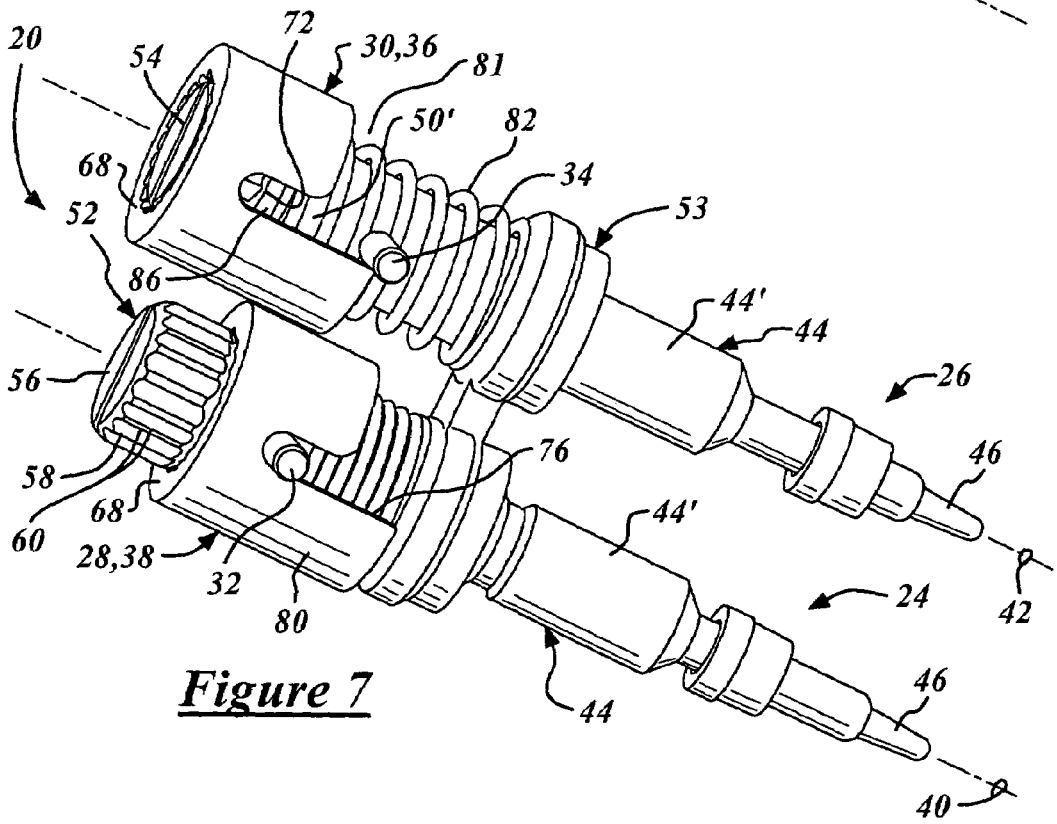
FIG. 7 is a perspective view of the fuel mixture adjustment valves similar to FIG. 6 except illustrating the low speed needle valve in an unlocked position and the high speed needle valve in a locked position.
Figure 11:
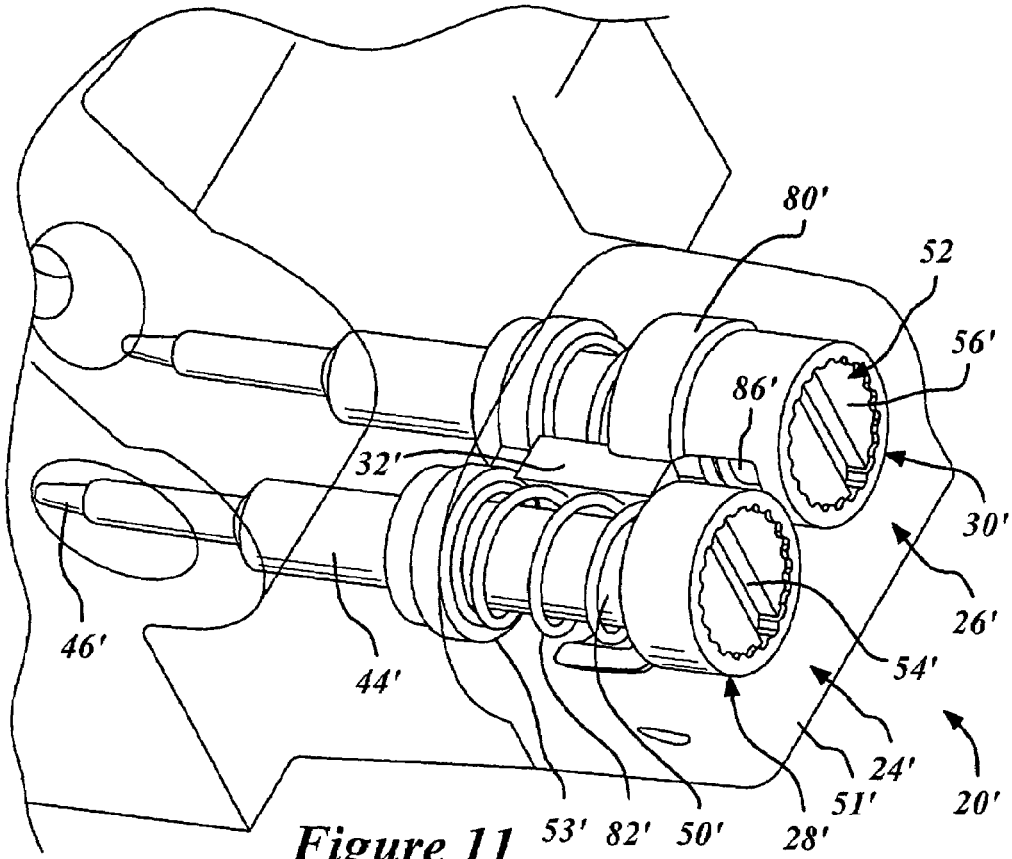
FIG. 11 is a perspective view of a modified form of a fuel mixture adjustment and limiter assembly.
Figure 12:
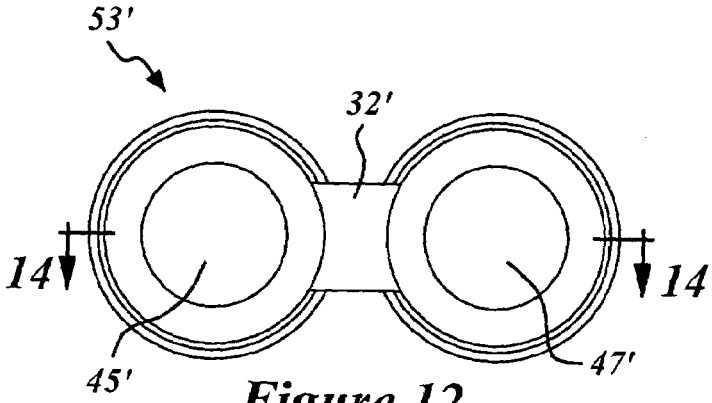
FIG. 12 is a end view of a grommet of the fuel adjustment and limiter assembly of FIG. 11.
Figure 13:
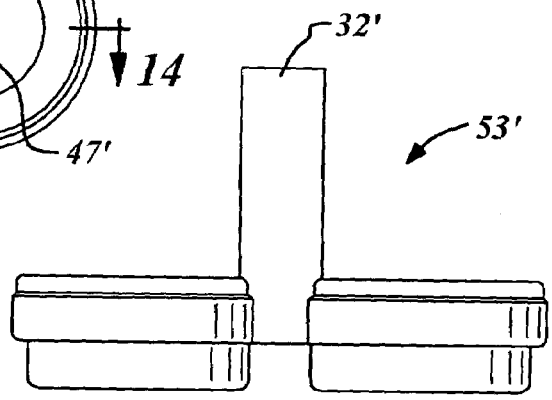
FIG. 13 is a top view of the grommet.
Figure 14:
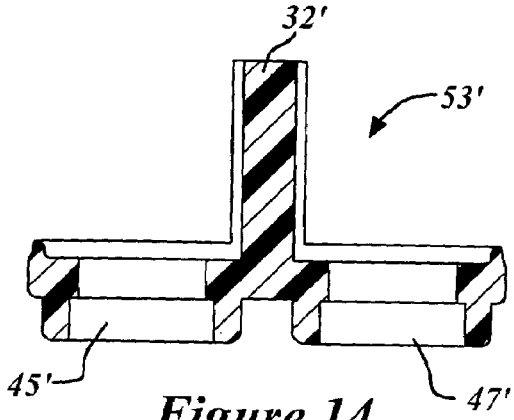
FIG. 14 is a cross section of the grommet taken along line 14—14 of FIG. 12.

Referring in more detail to the drawings, FIG. 1–7 illustrate a fuel flow rate adjustment and limiter assembly 20 in a carburetor body 22, embodying the present invention. The fuel adjustment and limiter assembly 20 has a low speed needle valve 24 and preferably a high speed needle valve 26, as is well known in the art, for adjusting fuel flow through the carburetor body 22. First and second collars 28, 30 carried by the respective first and second needle valves 24, 26 cooperate with respective first and second stop pins 32, 34 to limit the end user's ability to adjust the fuel flow. When the collars 28, 30 are in an extended releasable locked position 36 (as best shown in FIGS. 3 and 4), an end user can rotate the first and/or second needle valve 24, 26 to adjust fuel flow. The locked collars 28, 30 rotate in unison with the respective valves 24, 26 until they abut the respective pins 32, 34 in either circumferential direction, at which point further rotation of the respective needle valves 24, 26 by the end user is prevented, thus limiting the extent of fuel flow adjustment by the end user 22.

The first and second pins 32, 34 are rigid and fixed to the carburetor body 22, and the respective first and second collars 28, 30 are slidably received axially and engaged releasably to the respective needle valves 24, 26 when in the locked position 36. On some carburetor applications only one of the needle valves 24, 26 and associated collar and pin may be used. In either case, the collars 28, 30 are tamper proof and protectively sheltered by the carburetor body 22 whether in an unlocked position 38 for unlimited manufacture adjustment or in the lock position 36 for limited end user adjustment.

The low and high speed needle valves 24, 26 are generally parallel, disposed side-by-side, and rotate about a respective first rotation axis 40 and second rotation axis 42. Each valve 24, 26 has an axially extending shank or shaft 44 with a threaded central portion 44' threadably engaging a complementary threaded portion of the carburetor body 22 within the respective bores 45, 47. Rotation of the shafts 44 within the bores 45, 47 of the body 22 adjusts and controls the fuel flow within the carburetor by axial movement of its preferably tapered tip or distal end 46 in and out of a fuel feed channel or passage 48 and relative to the carburetor body 22 as is well known in the art.

Preferably, the bores 45, 47 generally communicate outward with a common cavity 49 defined by a shroud 51 of the carburetor body 22. The valves 24, 26 are generally positioned, preferably concentrically, between the body 22 and the rotating shafts 44 by a common bushing or grommet 53 disposed in the body 22 at the bottom of the cavity 49, acting primarily as a friction inducing retainer with preferably some degree of sealing characteristics. The shafts project axially outward through the bushing 53 and have a concentric cylindrical portion 50 and an enlarged head 52 disposed in the cavity 49. For end user adjustment of each valve 24, 26, it has a diametric recess or slot 54 in an end face 56 of its head 52. The recess 54 is generally perpendicular to the longitude or rotation axis 40 or 42 of the shaft 44 and receives a tool, such as a blade of a screwdriver (not shown), for rotation of the valve shaft 44.

As best shown in FIGS. 6–10, an outer circumferential surface 58 of the enlarged head 52 is generally perpendicular to the end surface 56 and carries at least one mating feature 60 which mates with at least one mating indicia 62 carried by a circumferential and radially inner face 64 of a sleeve 66 of each collar 28 and 30. Preferably, the mating features 60 and the mating indices 62 are a plurality of axially extending serrations or ribs but can also be any type of releasable mating engagement which when engaged inhibits relative rotation between the collar and head and when unlocked permits rotational adjustment between the enlarged head 52 and the respective collar 28 or 30.

The collars 28, 30 generally function independently of one-another. Each collar has a through-bore 63 substantially defined by the inner face 64 of the sleeve 66. The through-bore 63 communicates axially between and through an annular outward face 68 of the sleeve 66 and through a circumferential shoulder 70 disposed directly axially inward from face 68 of the sleeve 66 and extending radially inward of the bore 63. When the collars 28, 30 are in the locked position 36, the annular outward face 68 of the collars 28, 30 is substantially flush with the leading surface 56 of the head 52 and an inward annular surface 72 of the enlarged head 52 is preferably in axial contact with a radially inward annular face 73 of the shoulder 70 of the collars 28, 30. Preferably, the shroud 51 of the carburetor body 22 circumferentially encloses and extends axially over, and outboard of, the end faces of the locked collars 28, 30 and the valve heads 52. Preferably each collar 28, 30 is received with a slight clearance in the counter bore or common cavity 49 in the shroud 51 which is coaxial with the collar received therein. With the shroud 51 sheltering the collars 28, 30, the end user's only access for valve adjustment is from the exposed end surface 56 with the diametric recess 54 for receipt of a blade of a screw driver. Exposure of the locked collars 28, 30 to the end user is limited generally to the annular outward end face 68 thereof. With such limited exposure, tools generally available to the end user are not capable of unlocking the collars 28, 30 from the respective heads 52. During normal operation of the needle valves 24, 26, the end user can rotate the valves 24, 26 through a limited range of about one hundred and twenty degrees before the pins 32, 34, which preferably project radially inward from the shroud 51, abut either one of opposite circumferentially facing first and second stops 76, 78 carried by a circumferential canopy or finger 80 projecting axially inward from the shoulders 70 of the collars 28, 30. This limited range, however, may vary with any specific application or characteristics of the carburetor.

With final adjustments made by the end user, any tendency to fall out of adjustment, possibly due to external forces such as vibration, is minimized by the grommet 53 disposed generally about the shaft 44. A compression spring 82 is compressed axially between the grommet 53 and a radially inward annular face 83 of the shoulder 70 of the respective collars 28, 30 for biasing the collars into the locked position 36 and preferably are aligned coaxially with the collars by being received in an annular pocket 81 generally defined circumferentially between the stops 76, 78 and axially inward of a circumferential guide or end face 84. Preferably, when the collars 28, 30 are in the locked position 36, the respective pins 32, 34 are spaced axially only slightly inward from the guiding end face 84 and are radially and axially overlapped with the finger 80 since the pins 32, 34 must be engagable by the stops 76, 78 of the fingers or canopies 80.

To permit the collars 28, 30 to unlock from the valve heads 52, each collar has a blind slot 86 which extends axially through the guide 84 and into the sleeve 66, radially and has one edge or side co-planar with the face of the stop 76 of the finger or canopy 80. When the collar 28, 30 is rotated so that the stop 76 bears on the pin 32, 34, the pin is aligned with the slot 86 so that the collar can be depressed or moved axially inward to disengage from or unlock its associated valve head 52, so that its associated valve 24, 26 can be freely rotated relative to the carburetor body to adjust fuel flow. When the collar 28, 30 is in its extended or locked position 36 and its associated valve 24, 26 is rotated so that its guide 84 overlies its associated pin 32, 34, the collar cannot be axially depressed sufficiently to move to its disengaged or unlocked position 38 because its guide 84 will bear on its associated pin 32, 34.

Figure 18:
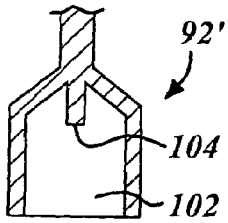
FIG. 18 is a cross section of a socket of a modification of the tool.
Figure 17:
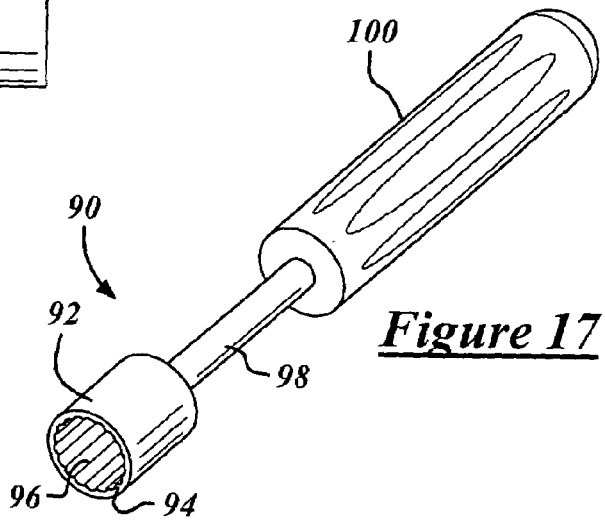
FIG. 17 is a perspective view of a special tool 90 utilized for adjustment by a manufacturer.

Often the carburetor manufacturer will make an initial adjustment of the low and high speed needle valves 24, 26 after they are assembled to the carburetor body 22 along with the collars 28, 30, stop pins 32, 34, springs 82 and bushing 53. Subsequently, after a carburetor is assembled on a specific engine and while the engine is operating, the high and low speed valves 24, 26 are adjusted typically by the engine manufacturer to establish the desired low and high speed fuel flow rates for a balance of the optimum engine efficiency, performance and compliance with engine exhaust gas emission regulations. These adjustments or settings of the needle valve 24, 26 can be made by the carburetor and engine manufactures by rotating each collar 28, 30 so that its stop surface 76 engages the pin 32, 34 thereby aligning the pin with the slot 86, depressing or displacing axially inward the collar to its unlocked position 36 shown in FIG. 5, rotating the needle valve 24, 26 to provide the desired adjustment or setting of the fuel flow rate controlled by the valve, and then releasing the depressed collar 28, 30 so that it will be returned by the bias of the spring 82 to the locked position 36 shown in FIG. 4 with the serrations 60, 62 on the collar and the valve head interengaged so that the collar rotates in unison with the valve to limit the extent to which the valve can be adjusted by an end user. The setting of the valve by the carburetor and engine manufacturers can be made utilizing a special tool 90 not available to an end user. As shown in FIG. 17, tool 90 has a socket 92 co-axially slidably receivable over the valve head 52 and with an annular face 94 on a free end which can bear on the collar to depress or axially move it to its unlocked position 38. Preferably, for rotating the valve, the socket 92 also has therein an array of circumferentially spaced and axially extending ribs or serrations 96 which are complementary to and engagable with the serrations 60 of the head for rotating the valve in response to rotation of the socket. To adjust the needle valves 24, 26, the socket can be disposed on the head 52, advanced to depress the collar, rotated it clockwise or counterclockwise as needed to adjust or set the valve and retracted to remove the socket and release the collar. The socket may be manipulated manually or advanced, rotated and retracted by an automated driver. As shown in FIG. 17, for manual manipulation of the socket 90, it may be either removably or permanently attached to one end of a shank 98 with a handle 100 fixed to the shank adjacent its other end. As shown in FIG. 18, in another form of a suitable socket 92', it may have a smooth internal bore 102 with a diameter slightly larger than the maximum diameter of the valve head 56 and a blade 104 disposed therein which can be received in the slot 54 when the collar 28, 30 is depressed or axially displaced to its unlocked position so that rotation of the blade 104 rotates the valve to adjust or set it to its desired position.

The greater the number of serrations 60, 62 the more refined can be the manufacturing adjustment of the valves 24, 26. Preferably, the collars 28, 30, pins 32, 34 and needle valves 24, 26 are made of a non-pliable metallic material to prevent unintentional distortion which may impact the adjustment range and further guard against tampering.

Figure 15:
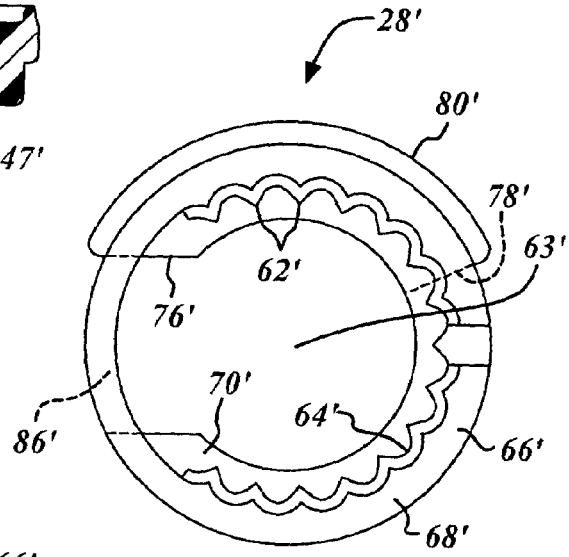
FIG. 15 is an end view of a collar of the modified version of the fuel adjustment and limiter assembly.
Figure 16:
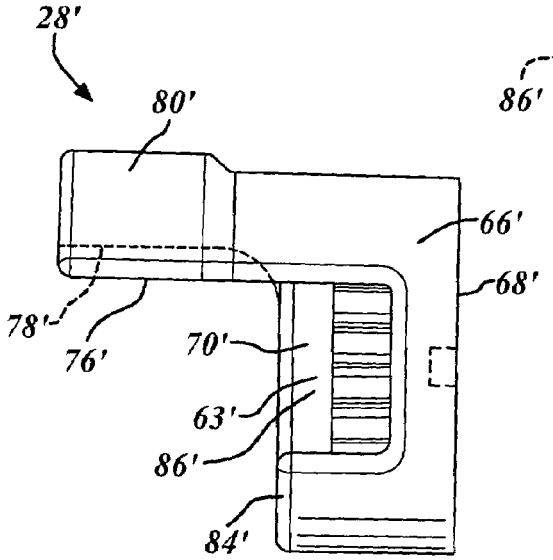
FIG. 16 is a side view of the collar of FIG. 15.

Referring to FIGS. 11–16, a modification of the fuel mixture adjustment assembly 20' is illustrated wherein the radially projecting pins 32, 34 fixed to the shroud 51 are replaced with a single block or pin 32' extending radially between and interconnected with the grommets 53'. Preferably the pin 32' and both grommets 53' are integral and made in one piece. In this application, the design of the grommets 53' is somewhat more complex, however, machining of the carburetor body 22' is simplified and the number of overall parts is reduced. Unlike assembly 20, the pin 32' can be molded as a unitary piece with the grommet 53'. As illustrated, the pin 32' and grommets 53' are preferably an injected molded plastic part having friction inducing and preferably sealing characteristics. Pin 32' is thus generally larger than the metallic pins 32, 34 to enhance strength. Likewise, as shown in FIGS. 15, 16, the slot 86' of a collar 28' is also larger to receive the pin 32'.

While the forms of the invention herein disclosed constitute presently preferred embodiments, many others are possible. For instance, the mating features 60 and indices 62 can be generally carried by the shoulder 70 of the collar 28, 30 and the inward annular surface 72 of the enlarged head 52 to accomplish a similar locking axial engagement. It is not intended herein to mention all the possible equivalent forms or ramifications of the invention. It is understood that the terms used herein are merely descriptive, rather than limiting, and that various changes may be made without departing from the spirit or scope of the invention.

I claim:

1. A fuel adjustment and limiter assembly for a carburetor comprising:

a carburetor body;

a fuel passage in the body;

a bore in the body along a rotation axis and communicating with the fuel passage and opening to the exterior of the body;

a shaft disposed in the bore and threaded rotatably to the body along the rotation axis, and the shaft having a tip at one end disposed adjustably in the fuel passage;

an enlarged head generally concentric to and projecting axially outward from the other end of the shaft, the enlarged head having at least one feature carried by the head;

a collar carried by the shaft adjacent the head and generally axially movable relative to the head, a first stop carried by the collar, a second stop carried by the collar and circumferentially spaced from the first stop, at least one indicia carried by the collar and releasably engageable with the at least one feature for rotation of the collar with the shaft, the collar being axially movable relative to the head to a locked position wherein the at least one indicia engages the at least one feature for rotation of the collar with the shaft and axially movable to an unlocked position spaced from the locked position wherein the indicia and feature are disengaged so that the shaft can rotate relative to the collar; and a pin carried by the carburetor body, disposed between the first and second stops and engageable by the first and second stops at least when the collar is in the locked position to limit rotation of the shaft relative to the carburetor body.

2. The fuel adjustment and limiter assembly set forth in claim 1 further comprising:

a shoulder of the collar projecting radially inward and carrying an annular face and an opposite annular face facing axially inward; and a compression spring disposed concentrically about the shaft and compressed axially between the body and the annular face for biasing the collar in the locked position.

3. The fuel adjustment and limiter assembly set forth in claim 2 further comprising a sleeve projecting axially outward from the shoulder and carrying a continuous inner face defining an axially extending through-bore, wherein the inner face defines at least in part the at least one mating indicia.

4. The fuel adjustment and limiter assembly set forth in claim 2 further comprising a grommet, supported by the body defining in part the bore, being in threaded engagement with the shaft, and wherein the compression spring is compressed axially between the grommet and the annular face.

5. The fuel adjustment and limiter assembly set forth in claim 1 further comprising:

a continuous circumferential surface of the enlarged head facing radially outward, and extending axially outward from an annular surface;

a plurality of axially extending serrations as the at least one feature, carried by the circumferential surface, profiled by the annular surface, and equally spaced circumferentially about the enlarged head;

an outer sleeve of the collar projecting axially outward from a shoulder; and a plurality of axially extending serrations as the at least one indicia, carried by the sleeve, and equally spaced circumferentially about the sleeve.

6. The fuel adjustment and limiter assembly set forth in claim 1 wherein the pin projects radially inward from the carburetor body.

7. The fuel adjustment and limiter assembly set forth in claim 4 wherein the shaft is in threaded engagement with the grommet.

8. The fuel adjustment and limiter assembly set forth in claim 7 wherein the pin projects axially outward from the grommet.

9. The fuel adjustment and limiter assembly set forth in claim 2 further comprising a canopy of the collar projecting axially inward from the shoulder and extending circumferentially between the first and second stops carried by the canopy.

10. The fuel adjustment and limiter assembly set forth in claim 9 wherein the compression spring is disposed radially inward of the canopy.

11. The fuel adjustment and limiter assembly set forth in claim 3 further comprising:

a canopy of the collar projecting axially inward from the shoulder and extending circumferentially between the first and second stops carried by the canopy; and a slot extending axially outward, through the shoulder and at least partially into the sleeve for receipt of the pin when the collar is in the unlocked position.

12. The fuel adjustment and limiter assembly set forth in claim 6 further comprising a shroud of the body projecting axially outward with respect to the rotation axis and the pin being engaged to the shroud.

13. The fuel adjustment and limiter assembly set forth in claim 2 wherein the compression spring is not in direct contact with the enlarged head.

14. The fuel adjustment and limiter assembly set forth in claim 3 further comprising an axially extending slot defined in part by the first stop and opened axially inward for receipt of the pin when the collar is shifted axially inward compressing the spring and moving from the locked position to the un-locked position.

15. The fuel adjustment and limiter assembly set forth in claim 5 comprising a tool for unlocking the collar having a socket carrying an annular face for abutting the collar when unlocking and having a plurality of axially extending inner serrations for engaging the plurality of axially extending serrations of the circumferential surface of the enlarged head for rotation of the head.

16. A fuel adjustment and limiter assembly for limiting adjustment of fuel flow in a carburetor comprising:

a valve having a rotatable elongated shaft and a head sheltered laterally by the carburetor;

a first collar received over the shaft and movable to telescopically overlie the head, the first collar carrying a first stop and a second stop spaced circumferentially from the first stop;

an unlocked position of the first collar wherein the first collar is spaced axially inward from the head and disengaged from the head so that the head and shaft can be rotated relative to the carburetor;

a locked position of the first collar wherein the first collar is releasably mated to the head for rotation thereafter in limited rotational relationship to the carburetor;

a pin carried by the carburetor and disposed circumferentially between the first and second stops at least when the first collar is in the locked position; and the pin being engageable by the first stop when the first collar is in the locked position and the valve is rotated for minimal fuel flow, and the pin is engageable by the second stop when the first collar is in the locked position and the valve is rotated for maximum fuel flow.

17. The fuel adjustment and limiter assembly set forth in claim 16 further comprising:

the valve being a low speed valve;

a high speed valve having a rotatable shaft and a head sheltered laterally by the carburetor;

a cylindrical second collar engaged telescopically to the head of the high speed valve along a second axis, the second collar carrying a third stop and an opposite fourth stop spaced circumferentially away from the third stop; and a second pin engaged to the carburetor and disposed circumferentially between the third and fourth stops and spaced axially inward from the head.

18. The fuel adjustment and limiter assembly set forth in claim 16 further comprising:

the valve being a low speed valve;

a high speed valve having a rotatable shaft and a head sheltered laterally by the carburetor;

a cylindrical second collar engaged telescopically to the head of the high speed valve along a second axis disposed parallel to the first axis, the second collar carrying a third stop and an opposite fourth stop spaced circumferentially away from the third stop; and the pin disposed axially inward from the first and second collars and projecting axially outward to locate between the first and second stops and the third and fourth stops.

19. The fuel adjustment and limiter assembly set forth in claim 18 wherein the first and third stops face counter-clockwise, the second and fourth stops face clockwise, and the pin is in contact with the fourth stop when the second collar is in the locked position and the high speed valve is rotated for minimal fuel flow, and the pin is in contact with the third stop when the second collar is in the locked position and the high speed valve is rotated for maximum fuel flow.

20. The fuel adjustment and limiter assembly set forth in claim 16 wherein the first collar is made of a non-pliable metallic material.

* * * * *